US005582384A

United States Patent [19]

Schoen

[11] Patent Number: 5,582,384

[45] Date of Patent: Dec. 10, 1996

[54] HOLDING DEVICE FOR RODS, TUBES, ETC.

[76] Inventor: Hans Schoen, Lange Horst 87, 44527 Hattingen, Germany

[21] Appl. No.: 372,762

[22] Filed: Jan. 13, 1995

[51] Int. Cl.[6] ..... A47G 25/12

[52] U.S. Cl. ..... 248/536; 248/74.1; 248/207; 248/540; 248/541; 248/912

[58] Field of Search ..... 248/74.1, 540, 248/541, 536, 207, 214, 558, 912; 403/4

[56] References Cited

U.S. PATENT DOCUMENTS

| | | | |
|---|---|---|---|
| 454,553 | 6/1891 | Whitten | 248/207 X |
| 694,888 | 3/1902 | Pfluger | 248/540 X |
| 935,730 | 10/1909 | Bacon | 248/207 |
| 1,737,214 | 11/1929 | Brown | 248/207 X |
| 2,493,851 | 1/1950 | Blaugrund | 248/536 X |
| 2,681,195 | 6/1954 | Bradt et al. | 248/540 X |
| 2,823,884 | 2/1958 | Lagerstrom | 248/207 |
| 3,332,652 | 7/1967 | Oaks | 248/541 X |
| 4,460,142 | 7/1984 | O'Rorke | 248/214 X |
| 4,941,633 | 7/1990 | Walker et al. | 248/912 X |

FOREIGN PATENT DOCUMENTS

| | | | |
|---|---|---|---|
| 612722 | 5/1935 | Germany | 248/912 |
| 9311951 | 8/1993 | Germany . | |
| 86855 | 11/1957 | Netherlands | 211/18 X |
| 13150 | 5/1897 | United Kingdom | 248/540 |

*Primary Examiner*—Ramon O. Ramirez
*Assistant Examiner*—Michael J. Turgeon
*Attorney, Agent, or Firm*—Robert W. Becker & Associates

[57] ABSTRACT

A holding device for elongate members has a base body with a C-shaped bracket with a first leg, a second leg, and a connecting bar. The C-shaped bracket has a securing screw extending through the first leg for clamping the holding device to a support. The base body has two parallel legs extending in a first plane of the first leg and pointing away from the C-shaped bracket. A plate is positioned in a second plane perpendicular to the first plane and is connected with adjacent edges to the connecting bar and the two parallel legs. The plate has a first and a second set of two grooves that extend parallel to one another on opposite sides of the plate. The first and second sets extend spaced from one another parallel to the connecting bar. The plate further has a third and fourth set of two grooves that extend parallel to one another on opposite sides of the plate. The third and fourth sets extend spaced from one another parallel to the two parallel legs. At least one annular member for clamping an elongate member is provided. It has a radial gap defining two oppositely arranged free ends of the annular member from which extend two flanges radially outwardly. The two parallel legs and the sets of two grooves are receiving elements for the annular member wherein the annular member is slipped onto one of the receiving elements. An arresting pin arrests the annular member on the receiving element.

13 Claims, 7 Drawing Sheets

HOLDING DEVICE FOR RODS, TUBES, ETC.

BACKGROUND OF THE INVENTION

The present invention relates to a holding device for rods, tubes, etc., especially for umbrella-shaped sun shades.

A holding device of this kind has been known for years. It is available at home improvement stores and gardening or furniture stores and, in general, is made of a U-shaped bracket for attachment to the edge of a table whereby at the lower leg of the U-shaped bracket a fastening screw positioned within a threaded bore is provided. The connecting bar of the U-shaped bracket which in the position of use extends vertically, is provided with an annular element that has provided in its wall a radially extending, manually operated pressure screw positioned within a threaded bore. For securing a sunshade in the form of an umbrella, the holding device is clamped at a suitable position to the table. Subsequently, the rod of the umbrella is inserted from the top into the annular element until it reaches the ground with its lower end. Then the pressure screw is fastened. Such known one-part holding devices are also usable for securing other rods or tubes in the aforedescribed manner.

However, such holding devices are not applicable in cases where it is desired to use a vertically extending wall element for attaching the rod or tube instead of a horizontally extending table top. Furthermore, such a holding device is not suited for connecting a horizontally extending rod to a table top.

It is therefore an object of the present invention to provide a holding device for rods or tubes or similar elements that is universally applicable for attaching rods or tubes or similar elements in a vertical or horizontal position to vertical and horizontal supports.

SUMMARY OF THE INVENTION

A holding device for elongate members according to the present invention is primarily characterized by:

A base body comprising a C-shaped bracket with a first leg, a second leg, and a connecting bar connecting the first and the second leg, the C-shaped bracket further having at least one securing screw extending through the first leg for clamping between the first and second leg a support structure;

The base body further comprising two parallel legs extending in a first plane, in which the first leg is positioned, and pointing away from the C-shaped bracket;

A plate positioned in a second plane perpendicular to the first plane so as to be connected with one edge to the connecting bar and with an adjacent edge to the two parallel legs;

The plate having a first set of two grooves extending parallel to one another on opposites sides of the plate;

The plate having a second set of two grooves extending parallel to one another on opposite sides of the plate so as to be spaced from the first of two grooves;

The first and second sets of two grooves extending parallel to the connecting bar;

The plate having a third set of two grooves extending parallel to one another on opposites of the plate;

The plate having a fourth set of two grooves extending parallel to one another on opposite sides of the plate so as to be spaced from the third set of two grooves;

The third and the fourth sets of two grooves extending parallel to the two parallel legs;

At least one annular member for receiving and clamping an elongate member therein;

The at least one annular member having a radial gap defining two oppositely arranged free ends of the annular member;

The at least one annular member further comprising two flanges extending substantially radially outwardly from the free ends;

The two parallel legs and the first, second, third, and fourth sets of two grooves being receiving elements for the at least one annular member, wherein the at least one annular member is slipped onto one of the receiving elements; and A means for arresting the at least one annular member on the one receiving element.

Preferably, the two parallel legs have an I-shaped cross-section with two crossbars and a connecting stay defining two recesses, wherein the connecting stay extends in the first plane.

Advantageously, when the at least one annular member is slipped onto one of the two parallel legs, each one of the flanges is received in one of the two recesses, and wherein the flanges match form-fittingly the two recesses.

Advantageously, the connecting stay has throughbores and the plate has throughbores within the first, second, third, and fourth sets of two grooves.

Expediently, the means for arresting is a spring-loaded arresting pin connected to one of the flanges of the at least one annular member so as to be slidable in a radial plane of the at least one annular member, wherein for arresting the at least one annular member in a desired position the arresting pin engages one of the throughbores.

Preferably, the one flange has a lateral projection with a transverse bore in which the arresting pin is positioned.

Advantageously, when the at least one annular member is slipped onto one of the first, second, third, and fourth sets, each one of the flanges is received in one of the two grooves, and the flanges match form-fittingly the two grooves.

In a preferred embodiment of the present invention, the connecting stay has hooks and the plate has hooks within the first, second, third, and fourth sets of two grooves.

Advantageously, the means for arresting is a spring-loaded arresting pin connected to one of the flanges of the at least one annular member so as to be slidable in a radial plane of the at least one annular member, wherein for arresting the at least one annular member in a desired position the arresting pin engages two neighboring ones of the hooks.

Preferably, the one flange has a lateral projection with a transverse bore in which the arresting pin is positioned.

Expediently, the at least one annular member has a radial threaded bore positioned opposite the gap and a clamping screw received in the threaded radial bore, wherein the clamping screw has a radially positioned inner end and a radially positioned outer end and wherein the radially positioned outer end has a turn knob for turning the clamping screw.

In yet another embodiment of the present invention the holding device further comprises a U-shaped pressure bracket having free legs connected by a crosspiece, the crosspiece of the U-shaped bracket connected freely rotatable to the outer end of the clamping screw and the free legs extending radially inwardly parallel to a radial plane of the annular member. One of the free legs is positioned above and the other of the free legs positioned below the radial plane of the annular member. The free ends of the free legs have a V-shaped cutout in a plane parallel to the radial plane.

Advantageously, a free edge of the plate, extending parallel to and remote from the two parallel legs, has a V-shaped projection extending over the length of the free edge. The V-shaped projection has cutouts at the first and second sets of two grooves.

Preferably, the two parallel legs have end faces with V-shaped cutouts in a plane parallel to the second plane.

Advantageously, a free edge of the plate, extending parallel to and remote from the connecting bar, has a V-shaped projection extending over the length of the free edge, wherein the V-shaped projection has cutouts at the third and fourth sets of two grooves.

According to the present invention, the preferred holding device is comprised of a base body with a plate that has sets of parallel grooves on both sides of the plate for receiving at least one annular member that is designed to receive and clamp the elongate member, i.e., the rods and/or tubes etc. The annular member is a separate part and can be slipped onto any of the receiving elements in the form of a set of two grooves or one of the parallel legs. Thus, the holding device is very versatile and can be used to clamp rods and/or tubes in a horizontal or vertical position to a horizontal or vertical support structure, as desired.

In a first simple embodiment of the present invention (without plate) it is suggested that the connecting bar of the C-shaped bracket has a projection in the direction of the extension of the threaded bore for the securing screw. The projection and the connecting bar are in the form of an I-profile with a connecting stay that is positioned transverse to the axis of the threaded bore. The C-shaped bracket also has two free legs extending opposite to the first and second legs of the C-shaped bracket. The free legs are also in the form of an I-profile. The connecting stay of the I-profile on the free leg opposite the second leg extends in the same plane as the connecting stay of the connecting bar/projection. The I-profile of the free leg opposite the first leg is rotated 90° relative to the other free leg about its longitudinal direction. The flanges of the annular member have such a thickness that they can be inserted into the various I-profiles from their end face such that they are form-fittingly received in the recesses of the I-profile. Thus, a rigid connection between the annular member and the free legs or projection of the bracket is ensured.

For arresting the annular member in the respective desired position the connecting stay of each I-profile is provided with arresting means such as sequentially arranged throughbores or hooks.

According to another embodiment of the present invention, one of the flanges of the annular member is provided with a transverse bore that receive a displacable, spring-loaded arresting pin which in the position of use of the annular member engages form-fittingly a throughbore, respectively, engages between two adjacent hooks of the connecting stay of the I-shaped profile.

In order to achieve an improved centering of the rod or the tube within the annular member, it is suggested that the free end face of the free legs or the projection is provided with a V-shaped cutout in the plane of the upper and lower parallel beams of the "I".

A means for clamping a rod or a tube etc. within the annular member is provided in the form of a clamping screw that is positioned in a radial, threaded bore positioned diametrically opposite the flanges. The clamping screw is provided with a turn knob at its rearward end. The clamping screw also comprises a pressure bracket that is U-shaped and is freely rotatable about the screw. The legs of the U-shaped pressure bracket extend on both sides (parallel to the radial plane) of the annular member and are provided at their free ends with V-shaped cutouts. Together with the oppositely arranged V-shaped cutout provided at the free end faces of the free legs/projection, a self-centering action is provided for the rod or tube received within the annular member even when the rod or tube is substantially thinner than the inner diameter of the annular member.

According to a further embodiment of the present invention the flanges of the annular member are provided with a lateral projection that has a transverse bore for receiving the spring-loaded arresting pin. For facilitating gripping of the arresting pin by hand, a spherical head is provided at its free end that functions as an actuating button.

The main advantage of the inventive holding device is that it is universally applicable for different arrangements and desired positioning of rods and tubes in house or garden. The bracket or base body can be attached as desired to a horizontal table top or to the edge of a vertical wall. Depending on whether it is desired to position the rod or tube horizontally or vertically, the receiving annular member is slipped onto the free legs or the projection of the C-shaped bracket (first embodiment) or the sets of two grooves, respectively, the two parallel legs of the second embodiment (corresponding to the I-shaped profile). The annular member is easily adjustable to rods or tubes of different sizes. Since the parallel flanges of the annular member are form-fittingly received in the recesses of the I-shaped profile, a rigid connection between the bracket or base body and the annular member is ensured. The annular member can be easily positioned differently with only a few manipulative steps.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
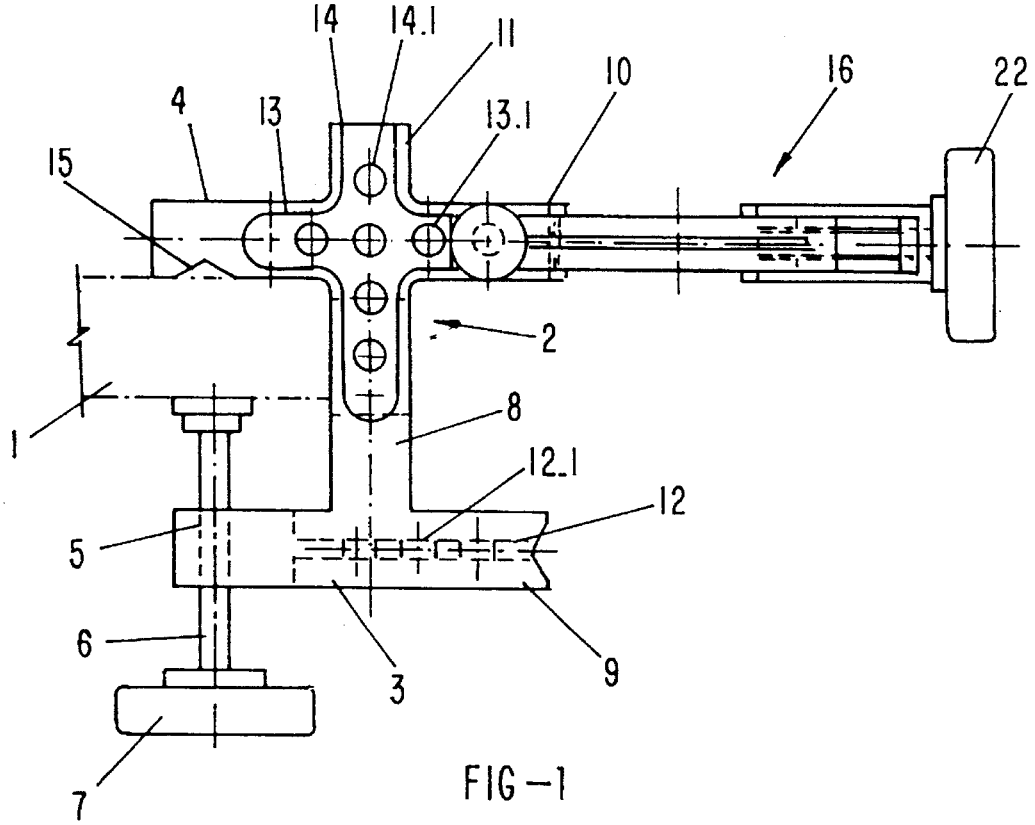
FIG. 1 shows a side view of a first embodiment of holding device in a first operating position.
Figure 2:
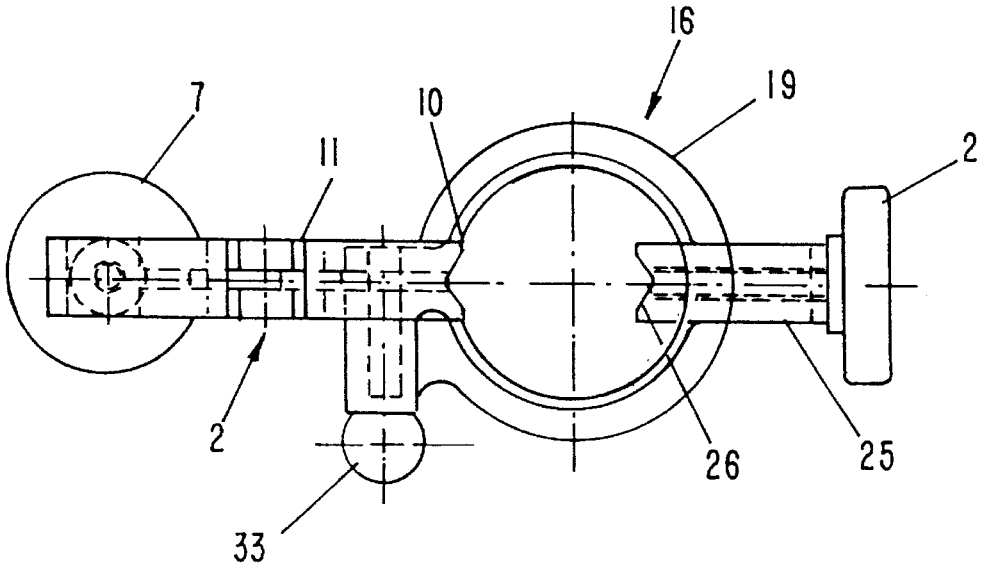
FIG. 2 shows a plan view of the holding device of FIG. 1.

The present invention will now be described in detail with the aid of several specific embodiments utilizing FIG. 1 through 13, FIGS. 1 and 2 show a first embodiment of the holding device for securing an umbrella-type sun shade to a support structure such as a table, Only the table top 1 of the table is represented in the drawing. The essentially H-shaped holding device 2 is provided with a first and a second parallel legs 3, 4 that are laterally slipped onto the table top 1 and with the connecting bar 8 form a C-shaped bracket. The first leg 3 has an adjusting screw 6 with an external turn knob 7 positioned within a threaded bore 5. By turning the fastening screw 6, the holding device 2 is fastened (clamped) to the table top 1.

The length of the connecting bar 8 of the bracket is designed such that the holding device 2 can be used with table tops of various thickness.

In addition to the aforementioned first and second legs 3, 4, the holding device 2 also has free legs 9, 10 of substantially identical length and a projection 11 as an extension of the connecting bar 8. The free legs 9, 10 as well as the connecting bar 8 (in part) and the projection 11 are in the form of an I-shaped profile. The holding device can be manufactured from metal in a pressure molding process. It is also possible to use a plastic material.

The I-shaped profile of the free leg 9 is positioned such that its connecting stay 12 is transverse to the axis of the threaded bore 5 and thus transverse to the plane of the essentially H-shaped holding device 2.-The free leg 10, the connecting bar 8, and the projection 11 are positioned such that the connecting stays 13, 14 extend in the central plane of the H-shaped holding device and thus perpendicular to the connecting stay 12. All connecting stays 12, 13, 14 are provided with a number of throughbores 12.1, 13.1, and 14.1 spaced relative to one another substantially at the same distance.

The second leg 4 is provided at its inner side with a wedge-shaped cutout 15 centrally positioned to the axis of the threaded bore 5. When a circular rod is to be clamped with the holding device, the cutout 15 ensures a slip-resistant fastening.

Figure 5:
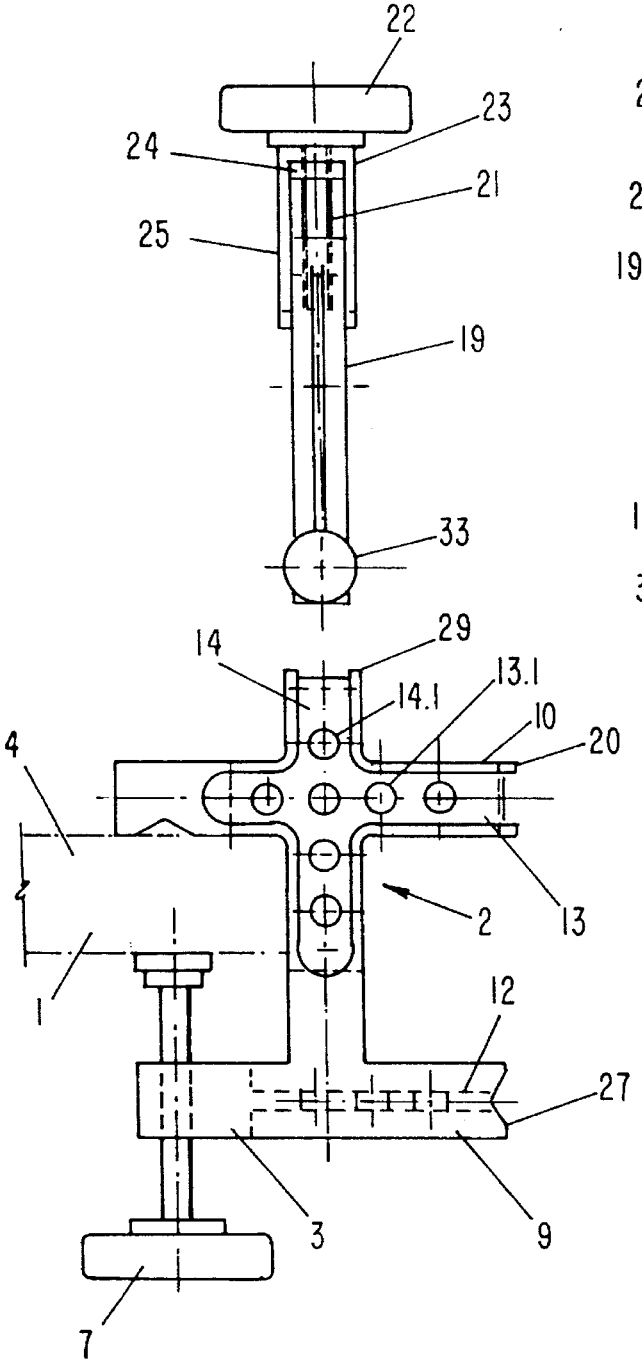
FIG. 5 shows a side view of the individual parts of the holding device before assembly for a third operational position.
Figure 6:
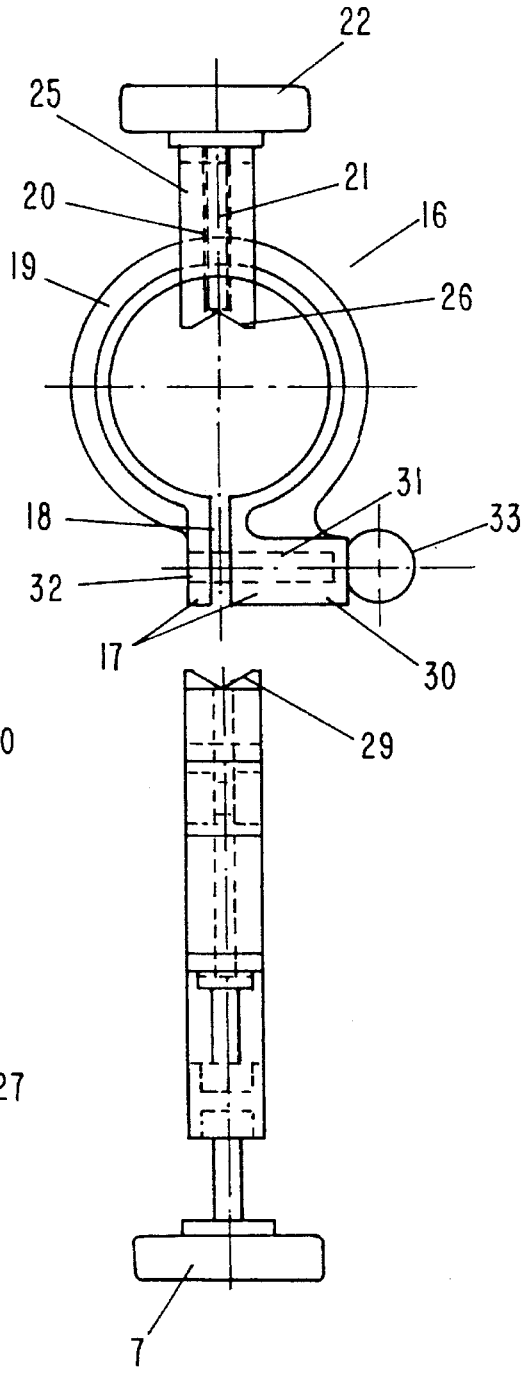
FIG. 6 shows an end view of the individual parts of the holding device of FIG. 5.

The contour of the separate annular member 16 is illustrated in the individual representations of FIGS. 5 and 6. The annular member 16 essentially has the shape of a circular clamp 19 with two radially extending flanges 17 between which a gap 18 is provided that has a width corresponding to the thickness of the connecting stays 12, 13, 14 of the I-shaped profiles. The almost closed annular member 16 comprises opposite the gap 18 a radially extending threaded bore 20 for receiving a clamping screw 21. The clamping screw 21 is provided with an external turn knob 22. A pressure bracket 23 is freely rotatably supported on the clamping screw 21 and is secured against axial displacement by a securing ring 24. The legs 25 of the pressure bracket 23 are provided at their free ends with a V-shaped cutout 26 extending parallel to the radial plane of the annular member.

The free ends of the free legs 9, 10 and of the projection 11 are also provided with V-shaped cutouts 27, 28, 29 extending in the plane of the upper and lower beams of the "I". Depending on the use of the annular member, the V-shaped cutout 26, on the one hand, and one of the V-shaped cutouts 27, 28, 29, on the other hand, cooperate for clamping a rod or tube (compare FIGS. 2, 3, 6).

At one flange 17 of the annular member 16 a lateral projection 30 with a transverse bore 31 is provided. Within the transverse bore 31 a spring-loaded arresting pin 32 is positioned that at its outer end has a spherical head as an actuating button 33. In its rest position the free end of the arresting pin 32 engages a transverse bore of the oppositely arranged flange that is aligned with the transverse bore 31.

Upon connecting the annular member 16 with the holding device 2, the flanges 17 are slipped over the free end of the I-shaped profile, while the arresting pin 32 is retracted by hand until the arresting pin 32 can engage one of the throughbores or hooks of the connecting stays 12, 13, 14. Depending on the diameter of the rod or tube to be secured, the annular member 16 is slipped to a greater or lesser extent onto the respective I-shaped profile. FIGS. 1, 2 and 3, 4, respectively, show the annular member 16 in a position in which the greatest possible width of the annular member for the insertion of a rod or tube is provided.

Figure 3:
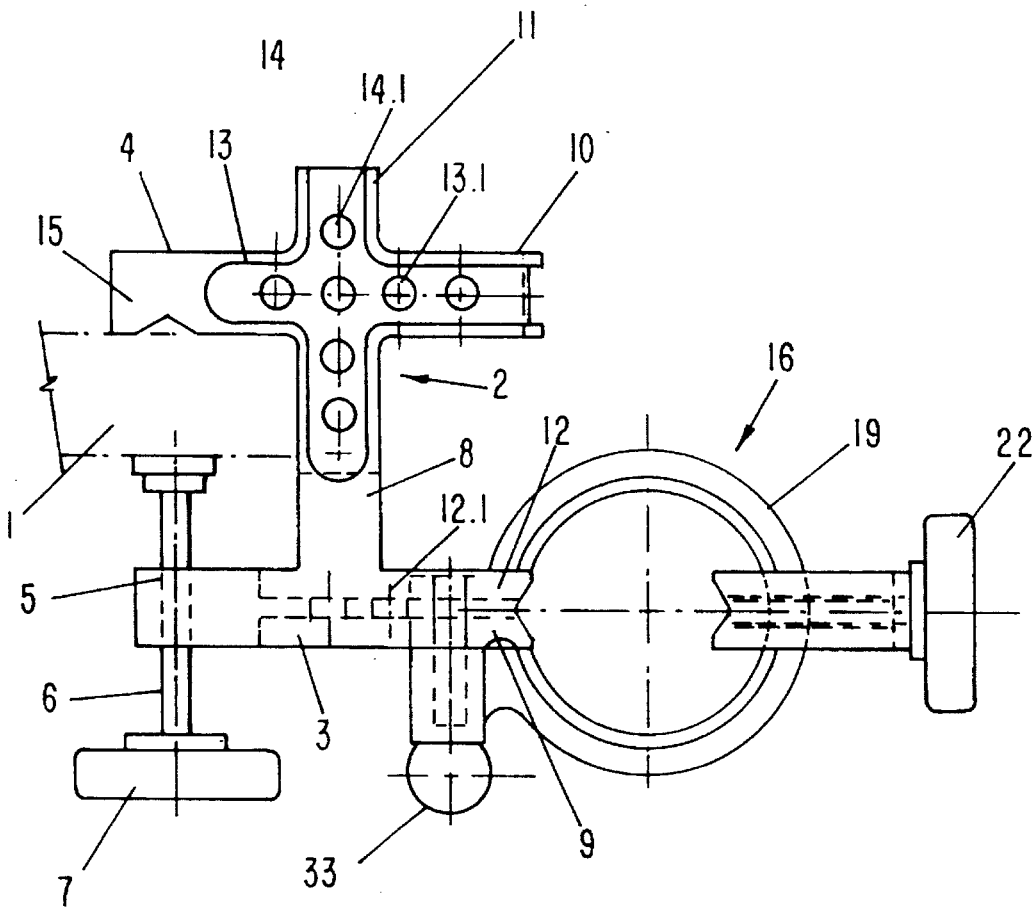
FIG. 3 shows a side view of the holding device in a second operating position.
Figure 4:
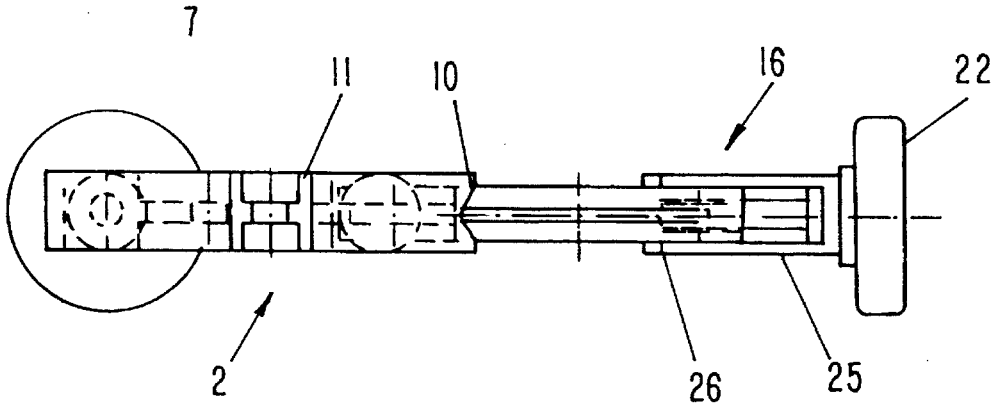
FIG. 4 shows a plan view of the holding device of FIG. 3.

FIGS. 3 and 4 show the holding device 2 in an operative position in which it is, for example, connected to a vertical wall and serves to hold a vertically extending rod. When the holding device 2 in this operating position is connected to a table top, it can serve to secure a horizontally extending rod. The operative position of FIGS. 5 and 6 is to be used when a rod is to be secured to a table top (above the plane of the table top) in a horizontal position.

FIGS. 7 to 13 show a second embodiment of the present invention in which the free legs 9 and 10 as well as the projection 11 are essentially provided twice so that two annular members can be positioned at the holding device spaced apart from one another and parallel to one another.

Figure 7:
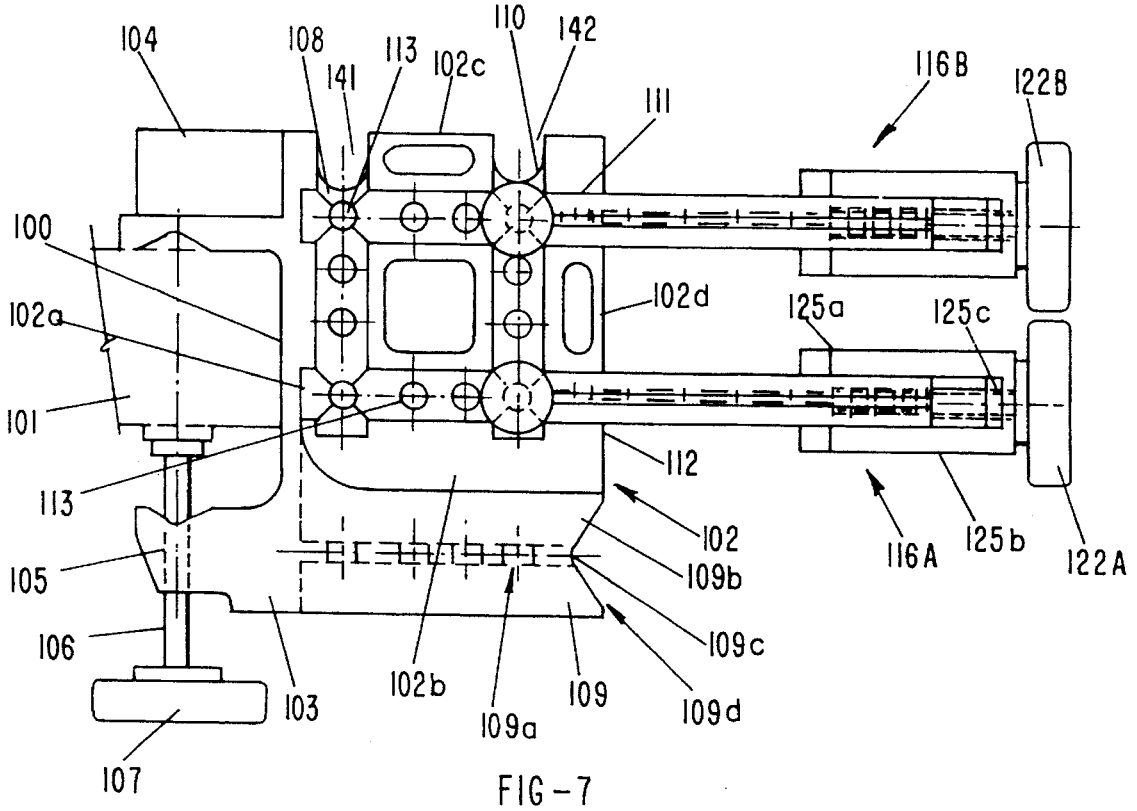
FIG. 7 shows a second embodiment of the inventive holding device.

FIG. 7 is a side view corresponding to the view of FIG. 1. This side view shows one of two parallel legs 109 extending in the same plane as the leg 103 of the C-shaped bracket used to secure the holding device to the table top 101 (support structure). The first leg 103 cooperates with the second leg 104 to clamp therebetween the table top 101. As in the first embodiment, a securing screw 106 with a turn knob 107 is provided in a threaded bore 105 for the clamping action. A connecting bar 100 extends between the first leg 103 and the second leg 104. The base body of the holding device further comprises in addition to the C-shaped bracket (103, 100, 104) a plate 102 positioned in a second plane that is perpendicular to the first plane in which the leg 103 and the two parallel legs 109 extend. The plate 102 is connected with one edge **102*a* to the connecting bar 100 and with an adjacent edge 102*b* to the two parallel legs 109. The plate 102 is provided with a first set of two grooves 108 that extend parallel to one another on opposite sides of the plate 102 and with a second set of two grooves 110 that extend parallel to one another on opposite sides of the plate 102 so as to be spaced from the first set of two grooves 108. The first and second sets of two grooves 108, 110 extend parallel to the connecting bar 100. The two sets of grooves 108, 110 in cross-section provide essentially the I-shaped profile of the projection 11/connecting bar 8 of the first embodiment for receiving the annular member 116*a*, *b*. The plate 102 further has a third set of two grooves 111 that extend parallel to one another on opposite sides of the plate 102 and a fourth set of two grooves 112 that extend parallel to one another on opposite sides of the plate 102 so as to be spaced from the third set of two grooves 111. The third and fourth sets of two grooves 111, 112 extend parallel to the two parallel legs 109. The sets of two grooves 112 and 111 essentially correspond to the I-shaped profile of the free leg 10** of the first embodiment.

The holding device further comprises annular members **116*a*, 116*b* which can be used in pairs or individually for securing a tube or a rod. The annular member 116***a*, 116*b* can be received in either one of the sets of two grooves (I-profiles) 108, 110, 111, 112. The two parallel legs 109 and the first, second, third, and fourth sets of two grooves 108, 110, 111, 112 are receiving elements for the annular member 116*a*, 116*b* whereby the annular member is essentially embodied as described in connection with the first embodiment of the present invention. The free flanges 117 of the annular member 116*a, b* are thus inserted into the grooves 108, 110, 111, 112, respectively, into the recesses of the two I-shaped parallel legs 109 in a form-fitting manner so that a rigid connection between the base body of the holding device and the annular member or members is provided.

As in the first embodiment the annular member comprises a means for arresting in the form of a spring-loaded arresting pin 132. The arresting pin 132 is connected to one of the flanges 117 of the annular member 116*a*, 116*b* so as to be slidable in the radial plane of the annular member. The connecting stay 109*c* of the I-shaped cross-section of the two parallel legs 109 is provided with throughbores 114 and the plate 102 is also provided with throughbores 113 within the first, second, third, and fourth sets of two grooves 108, 110, 111, 112.

For arresting the annular member in a desired position after having been slipped onto one of the receiving elements (I-profiles or grooves 108, 110, 111, 112, 109*a*, 109*b*), the arresting pin 132 engages one of the throughbores 113, 114. Preferably, one of the flanges 117 has a lateral projection with a transverse bore 131 in which the arresting pin 132 is positioned. The flanges 117 of the annular member form-fittingly fit into the two grooves of each set.

Instead of being provided with throughbores 113,114, the connecting stay 109*c* can be provided with hooks and the plate 102 can also be provided with hooks within the first, second, third, and fourth sets of two grooves 108, 110, 111, 112. The means for arresting in the form of a spring-loaded arresting pin 132 is then connected, after positioning the annular member as desired, by engaging between two neighboring hooks.

The annular member is provided with a radial threaded bore 120 positioned opposite the gap 118 and within the radial threaded bore 120 a clamping screw 121 is provided. The clamping screw 121 has a radially positioned inner end 121*a* and a radially positioned outer end 121*b*. The radial outer end has a turn knob 122 for turning the clamping screw 121. A U-shaped pressure bracket 125 with free legs 125*a*, 125*b* connected by a crosspiece 125*c* is provided. The crosspiece 125*c* of the U-shaped bracket is connected to the outer end 121*b* of the clamping screw 121 so as to be freely rotatable. The free legs 125*a* and 125*b* extend radially inwardly parallel to the radial plane of the annular member on both sides of the annular member 116. The free ends of the free legs 125*a*, 125*b* are provided with V-shaped cutouts 129 extending in a plane parallel to the radial plane.

The free edge 102*c* of the plate 102 that extends parallel to and remote from the two parallel legs 109 has a V-shaped projection 140 extending over the length of the free edge 102*c*. The V-shaped projection 140 has cutouts 141, 142 at the first and second sets of two grooves 108, 110. The V-shaped projection provides additional support when a rod or tube is fastened in annular members slipped onto and arrested in the grooves 108, 110.

The two parallel legs 109 have end faces with V-shaped cutouts 109*d* extending in the plane parallel to the second plane. The free edge 102*d* of the plate 102 that extends parallel to and remote from the connecting bar 100 has also a V-shaped projection 148 extending over the length of the free edge 102*d*. The V-shaped projection 148 is provided with cutouts 146, 147 at the third and fourth sets of two grooves 111, 112 and provides additional support when a rod or tube is fastened in annular members slipped onto and arrested in the grooves 111, 112.

FIG. 7 shows two annular members 116*a* and 116*b* inserted into the third and fourth set of grooves 111 and 112. This arrangement can be used to attach a rod or tube in the vertical position to a table top 101. Of course it is also possible to use only one of the annular members 116*a*, 116*b*, but the second annular member provides additional stability.

FIG. 7 shows the connecting stay 109*c* of the two parallel legs 109 in dashed lines and also shows the throughbores 114 penetrating the connecting stay 109*c*.

Figure 8:
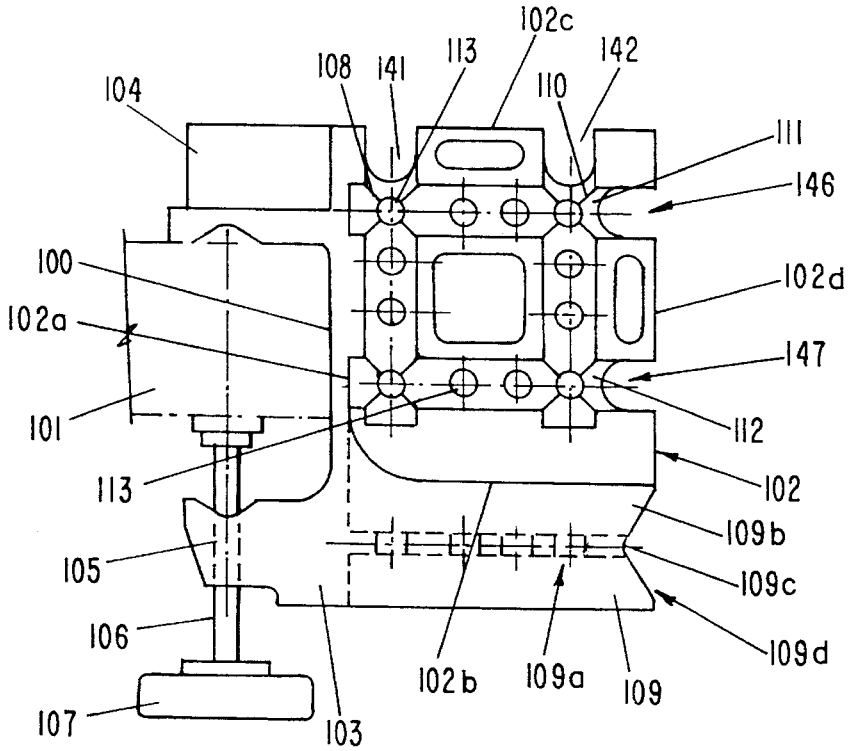
FIG. 8 shows the device of FIG. 7 without the annular members.

FIG. 8 shows the same view of the holding device with the two annular members 116*a*, 116*b* removed from the third and fourth sets of grooves.

Figure 9:
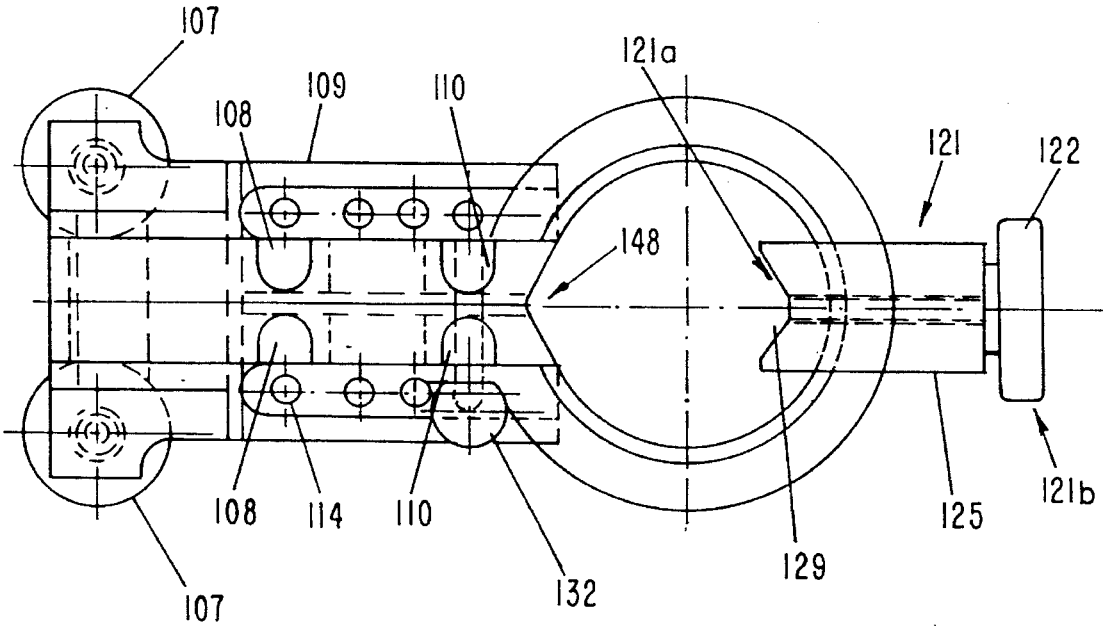
FIG. 9 shows a top view of the device of FIG. 7.

FIG. 9 is a top view of the device of FIG. 7 in which the first and second set of grooves 108, 110 are clearly shown as well as the recesses 109*a* of the two parallel legs 109 with the throughbores 114. Also visible is the V-shaped projection (top view) of the edge 102*d* of the plate 102. The upper leg 125*a* of the U-shaped bracket 125 with its V-shaped cutout 129 is also shown.

Figure 10:
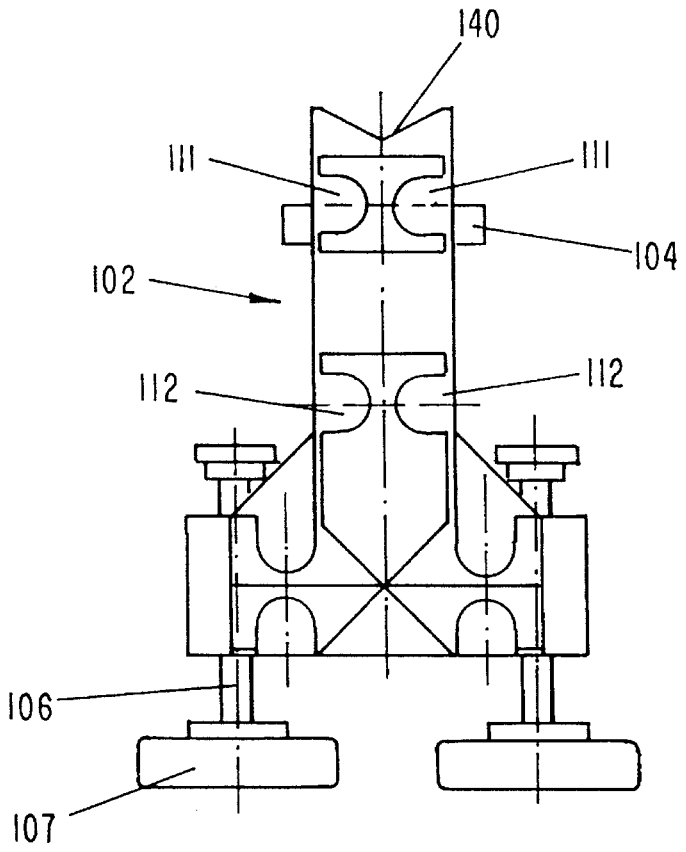
FIG. 10 shows an end view of FIG. 8.

FIG. 10 shows an end view of the holding device looking onto the edge 102*d* of the plate 102. The two sets of grooves 111 and 112 are shown. Also visible is the upper leg 104 of the C-shaped bracket for securing the holding device to the table top or any other support structure. The V-shaped projection of the edge 102*c* is also shown.

Figure 11:
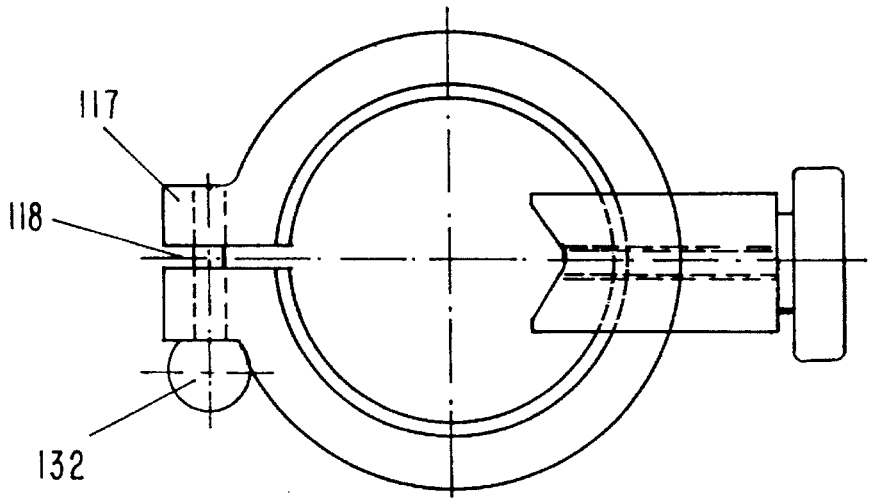
FIG. 11 shows a plan view of an annular member.

FIG. 11 shows in detail the annular member 116 with the flanges 117 and the gap 118 as well as the arresting pin 132.

Figure 12:
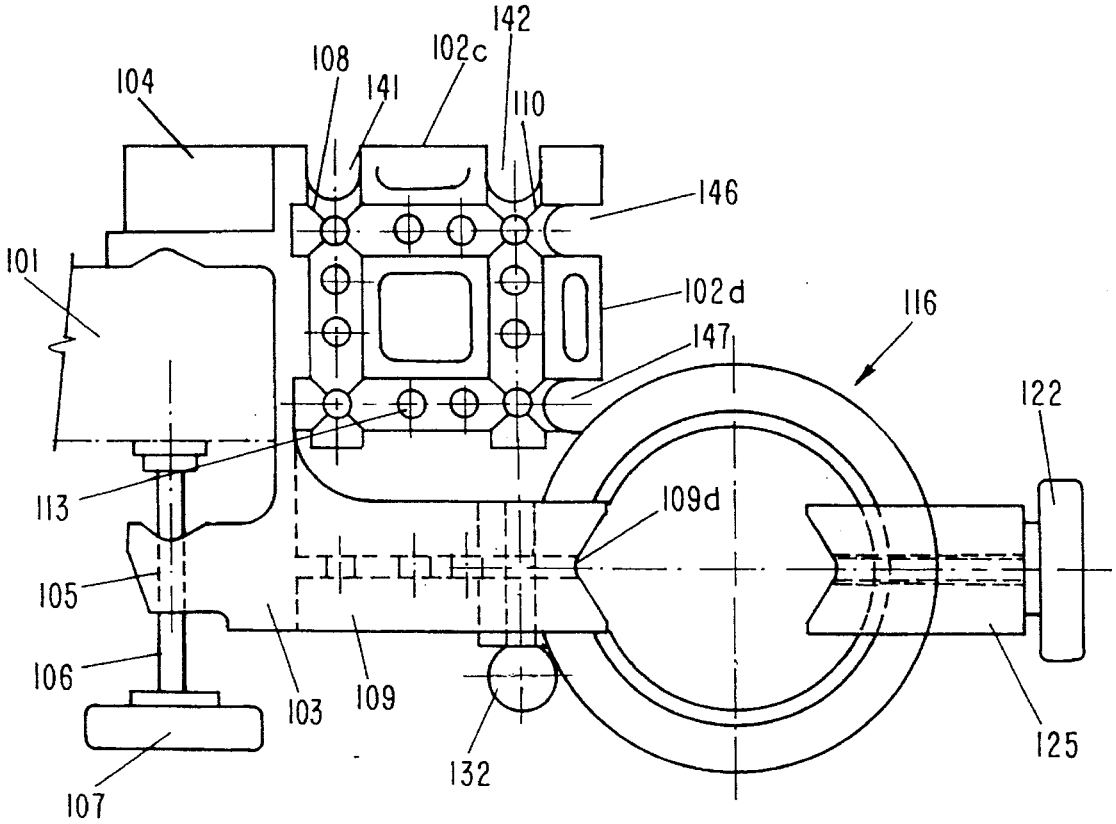
FIG. 12 shows a side view of the device with an annular member positioned at the lower leg.
Figure 13:
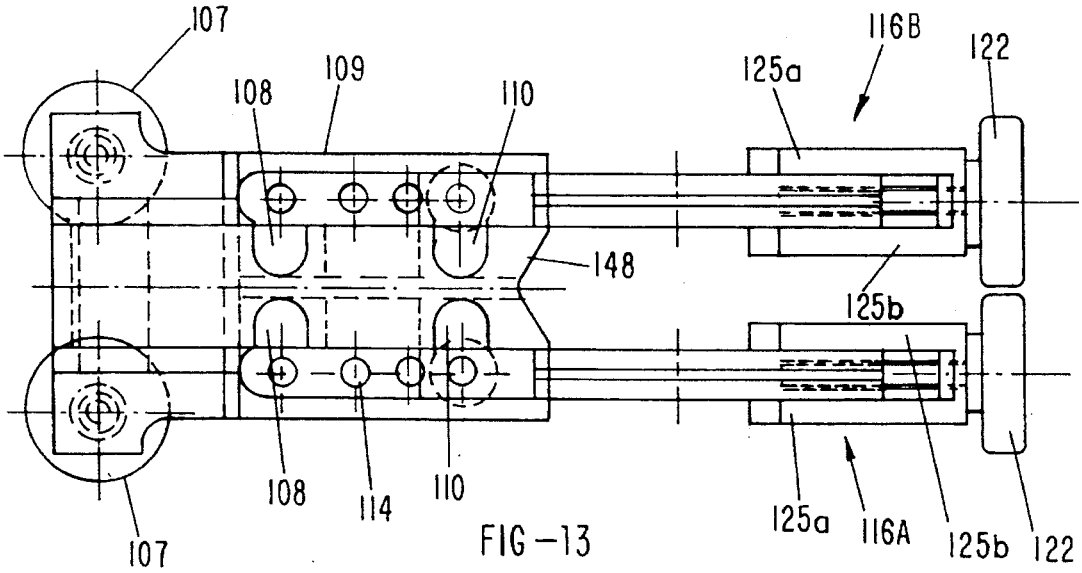
FIG. 13 shows a bottom view of the device of FIG. 12.

FIGS. 12 and 13 show the insertion of annular members 116*a* and 116*b* into the two parallel legs 109. FIG. 12 is a side view corresponding to the view shown in FIG. 7, and FIG. 13 is a top view corresponding to the view of FIG. 9. The shown arrangement can be used to secure a tube or rod in the horizontal position to a table top or, if the support structure 101 is a vertically extending structure, to secure a pole or rod or tube in the vertical position. It is possible to use one or two of the annular members 116 whereby the use of two annular members 116 provides additional stability to the rod or tube to be clamped.

The present invention is, of course, in no way restricted to the specific disclosure of the specification and drawings, but also encompasses any modifications within the scope of the appended claims.

What I claim is:

1. A holding device for elongate members, said holding device comprising:

a base body comprising a C-shaped bracket with a first leg, a second leg, and a connecting bar connecting said first and said second leg, said C-shaped bracket further having at least one securing screw extending through said first leg for clamping between said first and second legs a support structure;

said base body further comprising two parallel legs extending in a first plane, in which said first leg is positioned, and pointing away from said C-shaped bracket;

a plate positioned in a second plane perpendicular to said first plane so as to be connected with one edge to said connecting bar and with an adjacent edge to said two parallel legs;

said plate having a first set of two grooves extending parallel to one another on opposite sides of said plate;

said plate having a second set of two grooves extending parallel to one another on opposite sides of said plate so as to be spaced from said first set of two grooves;

said first and said second sets of two grooves extending parallel to said connecting bar;

said plate having a third set of two grooves extending parallel to one another on opposite sides of said plate;

said plate having a fourth set of two grooves extending parallel to one another on opposite sides of said plate so as to be spaced from said third set of two grooves;

said third and said fourth sets of two grooves extending parallel to said two parallel legs;

at least one annular member for receiving and clamping an elongate member therein;

said at least one annular member having a radial gap defining two oppositely arranged free ends of said annular member;

said at least one annular member further comprising two flanges extending substantially radially outwardly from said free ends;

said two parallel legs and said first, second, third, and fourth sets of two grooves being receiving elements for said at least one annular member, wherein said at least one annular member is slipped onto one of said receiving elements;

a means for arresting said at least one annular member on said one receiving element; and wherein a free edge of said plate, extending parallel to and remote from said two parallel legs, has a V-shaped projection extending over the length of said free edge, wherein said V-shaped projection has cutouts at said first and second sets of two grooves.

2. A holding device according to claim 1, wherein said two parallel legs have an I-shaped cross-section with two crossbars and a connecting stay defining two recesses, wherein said connecting stay extends in said first plane.

3. A holding device according to claim 2, wherein, when said at least one annular member is slipped onto one of said two parallel legs, each one of said flanges is received in one of said two recesses, and wherein said flanges match form-fittingly said two recesses.

4. A holding device according to claim 2, wherein said connecting stay has throughbores and wherein said plate has throughbores within said first, second, third, and fourth sets of two grooves.

5. A holding device according to claim 4, wherein said means for arresting is a spring-loaded arresting pin connected to one of said flanges of said at least one annular member so as to be slidable in a radial plane of said at least one annular member, wherein for arresting said at least one annular member in a desired position said arresting pin engages one of said throughbores.

6. A holding device according to claim 5, wherein said one flange has a lateral projection with a transverse bore in which said arresting pin is positioned.

7. A holding device according to claim 2, wherein, when said at least one annular member is slipped onto one of said first, second, third, and fourth sets, each one of said flanges is received in one of said two grooves, and wherein said flanges match form-fittingly said two grooves.

8. A holding device according to claim 7, wherein said means for arresting is a spring-loaded arresting pin connected to one of said flanges of said at least one annular member so as to be slidable in a radial plane of said at least one annular member, wherein for arresting said at least one annular member in a desired position said arresting pin engages two neighboring ones of said hooks.

9. A holding device according to claim 8, wherein said one flange has a lateral projection with a transverse bore in which said arresting pin is positioned.

10. A holding device according to claim 1, wherein said at least one annular member has a radial threaded bore positioned opposite said gap and a clamping screw received in said threaded radial bore, said clamping screw having a radially positioned inner end and a radially positioned outer end, wherein said radially outer end has a turn knob for turning said clamping screw.

11. A holding device according to claim 10, further comprising a U-shaped pressure bracket having free legs connected by a crosspiece, said crosspiece of said U-shaped bracket connected freely rotatable to said outer end of said clamping screw and said free legs extending radially inwardly parallel to a radial plane of said annular member, with one of said free legs positioned on one side of said annular member and the other of said free legs positioned on the other side of said annular member, wherein free ends of said free legs have a V-shaped cutout in a plane parallel to said radial plane.

12. A holding device according to claim 1, wherein said two parallel legs have end faces with V-shaped cutouts in a plane parallel to said second plane.

13. A holding device according to claim 1, wherein a free edge of said plate, extending parallel to and remote from said connecting bar, has a V-shaped projection extending over the length of said free edge, wherein said V-shaped projection has cutouts at said third and fourth sets of two grooves.

* * * * *